US008292450B2

(12) United States Patent
Kim

(10) Patent No.: US 8,292,450 B2
(45) **Date of Patent: *Oct. 23, 2012**

(54) HEADGEAR LIGHT

(75) Inventor: Paul Y. Kim, Santa Ana, CA (US)

(73) Assignee: Surefire, LLC, Fountain Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/798,818

(22) Filed: Apr. 12, 2010

(65) Prior Publication Data

US 2010/0202135 A1 Aug. 12, 2010

Related U.S. Application Data

(63) Continuation of application No. 11/331,779, filed on Jan. 12, 2006, now Pat. No. 7,722,205.

(51) Int. Cl.
*F21V 21/084* (2006.01)
*F21V 21/34* (2006.01)

(52) U.S. Cl. ..... 362/105; 362/191

(58) Field of Classification Search ..... 362/103, 362/105, 106, 108, 190, 191, 396; 248/229.13, 248/229.16, 231.81, 292.12, 292.13; 2/160, 2/209

See application file for complete search history.

(56) References Cited

U.S. PATENT DOCUMENTS 2,506,685 A 5/1950 Sadloski et al.
3,112,889 A 12/1963 Marmo et al.
4,092,704 A 5/1978 Malm
4,186,429 A 1/1980 Johnston
4,195,328 A 3/1980 Harris, Jr.
4,199,802 A 4/1980 Malm
4,299,344 A 11/1981 Yamashita et al.
4,406,040 A 9/1983 Cannone
4,425,600 A 1/1984 Barnhart
4,521,831 A 6/1985 Thayer
4,648,131 A 3/1987 Kawaguchi et al.
4,689,834 A 9/1987 McCarthy et al.
4,760,373 A 7/1988 Reilly
4,769,629 A 9/1988 Tigwell
4,793,007 A 12/1988 Barnett
4,862,331 A 8/1989 Hanabusa
4,901,210 A 2/1990 Hanabusa
4,967,323 A 10/1990 Johnson et al.
5,284,345 A 2/1994 Jehn
5,327,588 A 7/1994 Garneau
5,331,684 A 7/1994 Baril et al.
5,367,408 A 11/1994 Corsan et al.
5,408,393 A 4/1995 Becker
5,426,792 A 6/1995 Murasko
5,460,346 A 10/1995 Hirsch
5,479,325 A 12/1995 Chien
5,485,358 A 1/1996 Chien
5,488,361 A 1/1996 Perry
5,608,919 A 3/1997 Case
5,648,862 A 7/1997 Owen
5,658,065 A 8/1997 Jamieson
5,664,868 A 9/1997 Montalbano et al.
5,667,291 A * 9/1997 Caplan et al. ..... 362/105
(Continued)

*Primary Examiner* — Alan Cariaso

(57) ABSTRACT

Light apparatus particularly a headgear light comprising a light body removably securable to a headgear. The preferred embodiment of the light includes a mount assembly including a docking base that is removably attachable to a helmet or other headgear, and provides visible light, invisible light, and friend-or-foe light signals. The light body is compact for easy storage and handling, and can be quickly and easily installed on and removed from the headgear with one hand and without visual reference.

43 Claims, 5 Drawing Sheets

U.S. PATENT DOCUMENTS 5,667,292 A 9/1997 Sabalvaro, Jr.
5,738,432 A 4/1998 Okko et al.
5,755,367 A 5/1998 Yamada
5,758,947 A 6/1998 Glatt
5,853,242 A 12/1998 Bouffay et al.
5,910,764 A 6/1999 Hayden
6,113,244 A 9/2000 Baumgartner
6,206,543 B1 * 3/2001 Henry ..... 362/191
6,213,619 B1 4/2001 Yu
6,315,426 B1 11/2001 Buller, Jr.
6,378,237 B1 4/2002 Matthews et al.
6,388,390 B2 5/2002 Rachwal
6,439,733 B1 8/2002 Fischer et al.
6,464,369 B1 10/2002 Vega et al.
6,467,929 B2 10/2002 Lee
6,574,901 B1 6/2003 Solinsky et al.
6,612,714 B1 * 9/2003 Morre et al. ..... 362/191
6,616,294 B1 9/2003 Henry
6,619,813 B1 9/2003 Schnell
6,622,416 B2 9/2003 Kim
6,648,489 B2 11/2003 Fischer et al.
6,686,837 B2 2/2004 Kim
6,705,038 B2 3/2004 Davenport et al.
6,712,485 B2 3/2004 Matthews
6,721,962 B1 4/2004 Polaire
6,738,130 B1 5/2004 Chen
6,752,299 B2 6/2004 Shetler et al.
6,752,510 B1 6/2004 Appiah
6,764,194 B1 7/2004 Cooper
6,877,875 B2 4/2005 Yu et al.
6,905,223 B2 6/2005 Halasz
6,953,259 B2 10/2005 Parsons et al.
7,040,783 B1 5/2006 Christienson
7,048,403 B2 5/2006 Parker et al.
7,070,295 B1 7/2006 Lee
7,108,390 B2 * 9/2006 Lawless ..... 362/110
7,117,624 B2 10/2006 Kim
7,156,536 B1 * 1/2007 McCorkle ..... 362/106
7,168,821 B2 * 1/2007 Huang ..... 362/105
7,178,933 B1 * 2/2007 Chuang ..... 362/106
7,219,370 B1 * 5/2007 Teetzel et al. ..... 2/6.2
7,549,763 B2 6/2009 Kim et al.
7,722,205 B2 * 5/2010 Kim ..... 362/106
2003/0227773 A1 12/2003 Yang
2005/0174753 A1 8/2005 Cao et al.

* cited by examiner

HEADGEAR LIGHT

CROSS-REFERENCE TO RELATED APPLICATION

This application is a continuation of co-pending U.S. patent application Ser. No. 11/331,779 filed Jan. 12, 2006, which application is hereby incorporated in full herein by reference.

BACKGROUND OF THE INVENTION

The present invention pertains to mountable light assemblies and more particularly to a light that may be removably secured to a headgear such as a helmet.

Lights mounted on helmets and headgear have been known and used in many different forms. Examples of helmet-mounted lights include patents to: Malm, U.S. Pat. No. 4,092,704; Johnston, U.S. Pat. No. 4,186,429; Barnett, U.S. Pat. No. 4,793,007; Hanabusa, U.S. Pat. No. 4,862,331; Hanabusa, U.S. Pat. No. 4,901,210; Becker, U.S. Pat. No. 5,408,393; Case, U.S. Pat. No. 5,608,919; Fischer et al., U.S. Pat. No. 6,439,733 B1; Fischer et al. U.S. Pat. No. 6,648,489 B2; and Appiah, U.S. Pat. No. 6,752,510 B1. These patents teach a visible light in combination with a helmet or headgear. The inventions disclosed in these patents have various operational characteristics and require varying degrees of effort to remove or install the lights.

A clamp that mounts on the brim of a helmet is shown in U.S. Pat. No. 5,331,684 to Baril et al. One end of this clamp is made for attachment to the front of a standard army issue helmet and the other end of this clamp is made to accept standard issue night vision goggles. A device for mounting night vision goggles on a helmet is also shown in U.S. Pat. No. 4,689,834 to McCarthy et al.

What is needed and has not been found in the prior art or the foregoing patents, however, is a helmet or other headgear-mountable light that can be rigidly attached to the helmet or other headgear and includes a light body that can be readily removed or installed with one hand in a substantially continuous motion. Also not taught in the prior art is the ability to complete such installation and removal without visual reference while the helmet or headgear is being worn. There has also been a need for a helmet or other headgear in combination with a light that provides visible light, invisible light, and/or Identify Friend or Foe ("IFF") light. Side mounting capability in combination with invisible light and/or IFF light is also not taught in the prior art. Also not taught in the prior art is such a combination that is small enough so that the light body can be readily manipulated with one hand and stored in a pants or shirt pocket.

SUMMARY OF THE INVENTION

According to an aspect of the present invention, a helmet or headgear-mounted light includes a mount assembly and a light body. The light body provides one or more of the following in any combination: a visible light source, a night vision light source that may be in the visible or invisible range, and/or an IFF light source. In a preferred embodiment, the helmet to be used is standard government-issue to the armed forces. The mount assembly is designed to be securely attached to the brim of the helmet with the light sources facing generally forward. This enables the present invention to be mounted on the side of the helmet or headgear or in some other location where it will not interfere with other helmet-mounted devices such as night-vision goggles.

In the preferred embodiment, the light body includes a battery housing for a battery comprising at least one battery cell for supplying power as needed to energize the light sources.

According to a preferred embodiment of the present invention, the visible light source has three levels of intensity allowing the user to illuminate the area being faced with different levels of brightness. Depending upon the tactical situation, it may be desirable to use low levels of light for navigation purposes or for investigating dark areas without necessarily compromising security. In other situations, in which user security is not a consideration, higher levels of brightness may be used to illuminate areas that may conceal hazardous conditions.

A night vision light source, such as invisible infrared or visible red, can be used for area illumination in situations where night vision capability must be maintained and where night vision devices and/or infrared capable cameras may be in use.

In the preferred embodiment, the IFF light can be a blinking green LED with a predetermined repetition rate. In hostile environments where reliable audible communication is not feasible, the flashing green light signals the presence of an individual whose identity is that of a "friend," assuming that the signaling device has not fallen into hostile hands. Alternatively, the IFF light can be infrared or other invisible light.

In the preferred embodiment, the mount assembly includes a mounting bracket, mounting screws, a docking base, and a resilient pad. The docking base serves as a quick-release platform upon which the light body can be quickly and rigidly attached and quickly removed. The mounting screws secure the docking base to the mounting bracket. In an alternative embodiment, the mounting screws secure the mounting bracket to the helmet or headgear.

The docking base includes attachment channels that engage complementary attachment rails that are part of the light body. The docking base also includes a quick-release lever that has a latch and a quick-release button. The latch engages a catch or slot on the light body to keep the light body attached to the docking base.

When a user depresses the quick-release button, the latch is disengaged from the slot, thereby allowing the light body to be removed from the docking base by a simple sliding motion. The quick-release lever is resilient and the latch is preferably tapered, so that together they act to allow the latch to automatically reengage the catch when the light body is slid back onto the docking base.

The light body typically includes a visible light source, a night vision light source, and an IFF light source. The night vision light source preferably provides light such as invisible infrared, but may instead be a visible red light that is compatible with night vision devices while providing low level area illumination. In the preferred embodiment, LED's are the light sources because of their low power consumption and long life. The visible light source and the night vision light source are typically controlled by a single three-position switch that either activates (1) only visible lighting, (2) only night vision lighting, or (3) neither. The IFF light source is typically controlled by a separate, dedicated on/off switch. The light body of the preferred embodiment is also provided with a brightness control for varying the brightness of the visible light.

Accordingly, a light according to a preferred embodiment of the present invention comprises: a mount assembly removably attachable to a headgear such as a helmet, the mount assembly including a docking base adapted to lockably engage a light body; and a light body adapted to lockably engage the docking base, the light body including at least one light source.

According to another aspect of the present invention a preferred light embodiment comprises: a mount assembly removably attachable to a headgear and including a docking base; a light body including at least one light source; and a first attachment device carried by the docking base and a second attachment device carried by the light body, the first attachment device and the second attachment device adapted for cooperatively attaching the light body to the mount assembly when the light body is applied to the docking base and displaced in a predetermined direction with respect thereto.

According to a further aspect of the present invention, there is provided light apparatus comprising: a mount assembly removably attachable to a headgear such as a helmet and including a docking base; a light body including at least one light source; and the mount assembly and the light body adapted to be automatically locked to one another when the light body is applied to the docking base and displaced in a predetermined direction along the docking base. One of the mount assembly and the light body includes an actuator for unlocking the light body from the docking base; and the mount assembly and the light body are adapted to be detached from one another when the actuator is actuated and the light body is displaced in a direction opposite the predetermined direction along the docking base. In a preferred example, one of the docking base and the light body includes a channel and the other of the docking base and the light body includes a rail complementary to the channel for slidably engaging the light body along the docking base.

According to yet another aspect of the present invention, there is provided a light apparatus comprising: a headgear; a docking base secured to the headgear; a light body including at least one light source; and the docking base and the light body adapted to be automatically locked to one another when the light body is applied to the docking base and displaced in a predetermined direction along the docking base.

A preferred manner of practicing the present invention is provided by a method of attaching a light to a headgear, comprising: providing a headgear with a docking base; providing a light body including at least one light source; placing the headgear on a user's head; the user grasping the light body with one hand and, in a substantially continuous motion of that one hand, aligning the light body with the docking base, sliding the light body onto the docking base, and releasably locking the light body to the docking base. When the user desires to remove the light body from the headgear, the method continues by the user grasping the light body with one hand, and in a substantially continuous motion of that one hand, unlocking the light body from the docking base and sliding the light body off the docking base. The sliding and locking steps during installation of the light body to the docking base, and the unlocking and sliding steps during removal of the light body from the docking base, may be performed without visual reference by the user.

The step of providing the headgear with the docking base may include: providing a headgear; providing a mount assembly including the docking base; and securing the mount assembly to a side of the headgear. During the headgear providing step, the headgear may comprise a helmet.

BRIEF DESCRIPTION OF THE DRAWINGS

The novel features which are characteristic of the invention, both as to structure and method of operation thereof, together with further advantages thereof, will be understood from the following description, considered in connection with the accompanying drawings, in which the preferred embodiment of the invention is illustrated by way of example. It is to be expressly understood, however, that the drawings are for illustration and description only and not as a definition of the limits or scope of the invention.

DETAILED DESCRIPTION OF THE PREFERRED EMBODIMENT

In the following description, a specific arrangement, construction, and other details are set forth in order to provide a more thorough understanding of the instant invention. It will be apparent to those skilled in the art that the instant invention may be practiced without these specific details and that other embodiments are within the scope of the instant invention.

Figure 1:
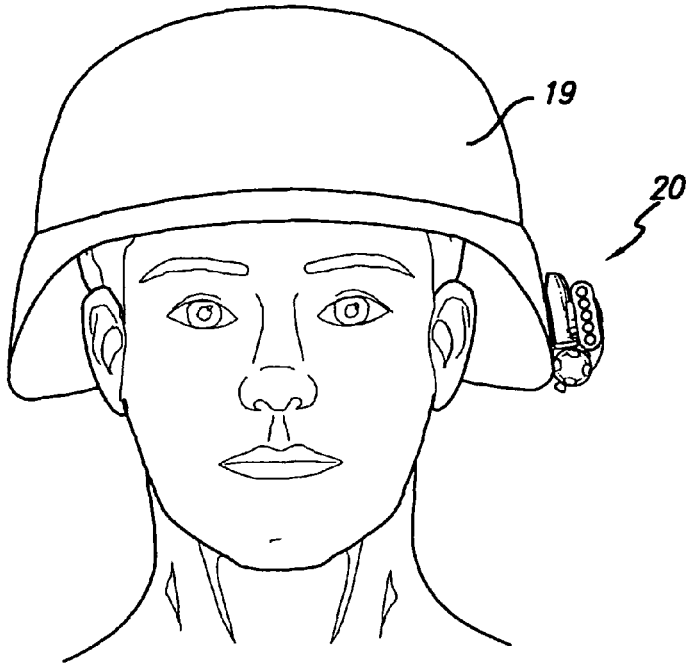
FIG. 1 is a front view of a preferred embodiment of a light assembly according to the instant invention installed on the brim of a helmet as worn by an individual.
Figure 2:
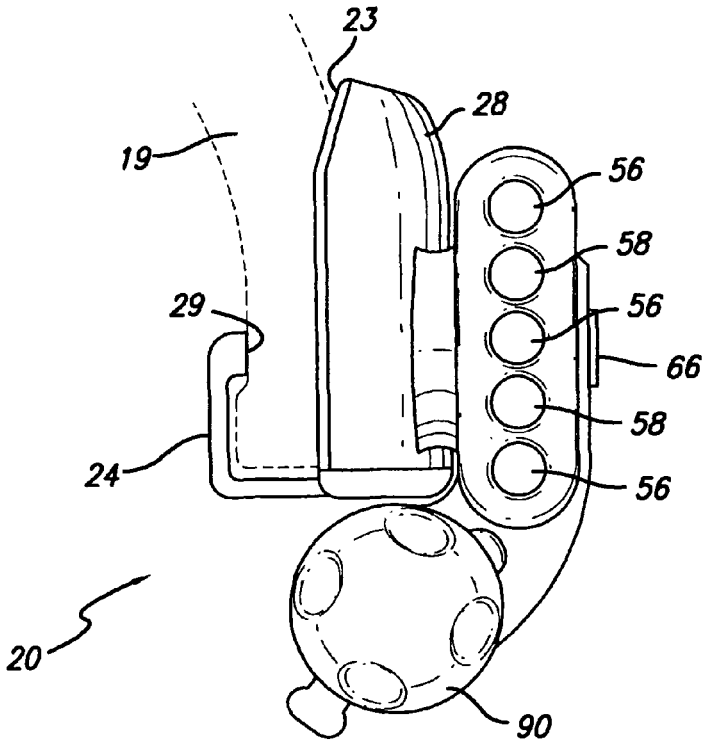
FIG. 2 is a front view of the preferred light of FIG. 1 shown in increased scale as mounted on the brim of a helmet.
Figure 3:
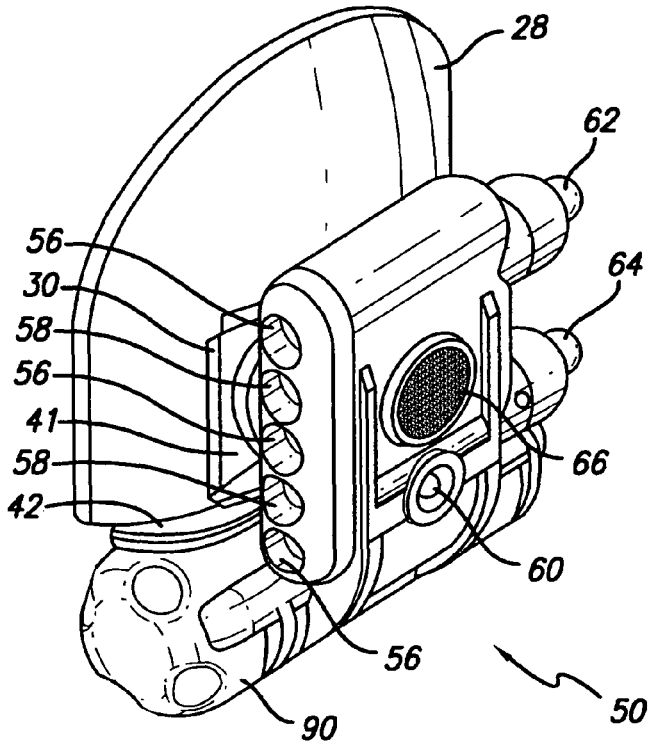
FIG. 3 is a perspective view of the preferred light embodiment of FIG. 2.

FIGS. 1-9 show a preferred embodiment of a light apparatus or light 20 of the instant invention. FIG. 1 shows an individual wearing a helmet 19 with a light 20 of the present invention mounted on the helmet. As best seen in FIGS. 4, 5, 6, and 7, the preferred embodiment of the light 20 includes a mount assembly 22 comprising a mounting bracket 24 with mounting prongs 29 spaced from an opposing plate 21, mounting screws 26 threaded through threaded apertures in the opposing plate 21, a docking base 30, and a resilient pad 28. The resilient pad 28 is preferably of an elastomeric material such as neoprene, and has a contact surface 23 that contacts the outer surface of a helmet 19 or headgear. In an alternative embodiment, the resilient pad 28 is optional and need not be included in the mount assembly 22.

FIG. 1 shows the overall size of the preferred embodiment of the light 20. In this preferred embodiment, the overall size is less than 2.5 inches by 2.5 inches by 1.5 inches. This size is well-suited for achieving an objective of the instant invention which is to provide a helmet-mountable light that can be readily installed to or removed from a helmet or other headgear with only one hand and without visual reference.

Figure 5:
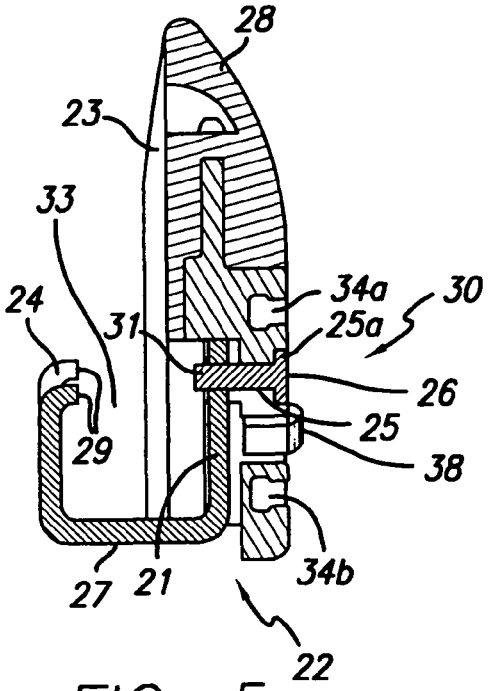
FIG. 5 is a sectional view of the mount assembly of FIG. 4 taken along the line 5-5 and viewed in the direction of the appended arrows.
Figure 6:
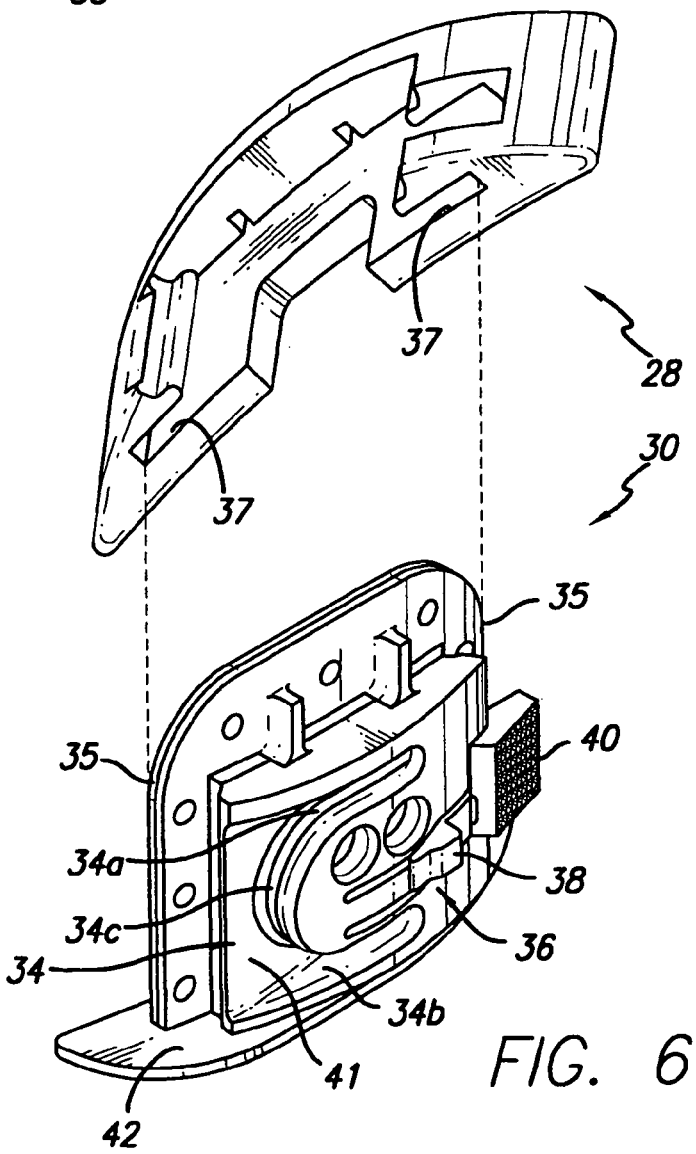
FIG. 6 is an exploded perspective view of the docking base and resilient pad of the mount assembly.
Figure 7:
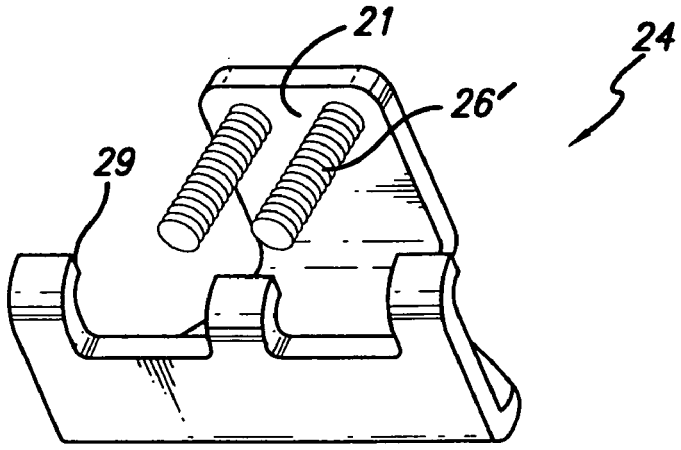
FIG. 7 is a perspective view of the helmet mounting bracket of the mount assembly of FIG. 5.

As shown in FIG. 5, in the preferred embodiment the headed attachment screws 26 attach the docking base 30 to the opposing plate 21 of the mounting bracket 24, the screws 26 extending through bores 25 in the docking base 30 with the screw heads restrained by the annular ledge of the counterbores 25*a*. The docking base 30 and the resilient pad 28 are secured together, with portions 35 of the docking base 30 being fitted into slots 37 in the pad 28 (FIG. 6). The screws 26 are short enough so that they do not contact the helmet 19 in this embodiment, and the gap 33 between the mounting prongs 29 and the pad contact surface 23 produces a loose fit with the helmet 19 when the mount assembly 22 is applied to the helmet 19. It may be appreciated that tightening of the screws 26 into the threaded apertures 31 of the plate 21 pulls the prongs 29 against the inner surface of the helmet 19. Further tightening of the screws 25 urges the docking base 30 and its secured resilient pad 28 inwardly toward the helmet 19, compressing the secured resilient pad 28 against the outer surface of the helmet 19 and clamping the helmet 19 between the prongs 29 and the pad 28. In this manner, the mount assembly 22 is securely mounted to the helmet 19 or other headgear.

To install the preferred embodiment of the mount assembly 22 on the helmet 19, a user pushes the mount assembly 22 onto the brim of the helmet 19 with the triangularly arranged bracket prongs 29 facing the inner surface of the helmet 19 and the resilient pad's contact surface 23 facing the helmet's outer surface, and with the lower bracket portion 27 facing and preferably engaging the edge of the helmet's brim. The user thereupon tightens the screws 26 as described above, securing the mount assembly including the docking base 30 to the helmet 19.

The resilient nature of the resilient pad 28 allows it to compressively fit differing helmet 19 or other headgear thicknesses, as well as to accommodate irregularities in the outer surface of the helmet 19 or other headgear. This resilient nature further enables the resilient pad 28 to conform to differing curvature due to differing mounting locations or differing sizes of helmet 19 or other headgear.

To install an alternative embodiment of the mount assembly 22 having screws 26' that are long enough to contact the helmet 19 or headgear, the mount assembly 22 is installed by first loosening the screws 26' until the distance between the mounting prongs 29 and the tips of the screws 26' is large enough to clear the brim of the helmet 19. The mount assembly 22 is then pushed onto the brim of the helmet 19 with the prongs 29 facing the helmet's inner surface and the ends of the screws 26' facing the helmet's outer surface, with the lower bracket portion 27 facing and preferably engaging the edge of the brim. The screws 26' are then tightened until they contact the helmet's outer surface, forcing the prongs 29 against the helmet's inner surface and clamping the mount assembly 22 to the helmet 19. In this alternative embodiment, the securement function of the resilient pad 28 is decreased, and the resilient pad may be omitted from this embodiment if desired.

Figure 4:
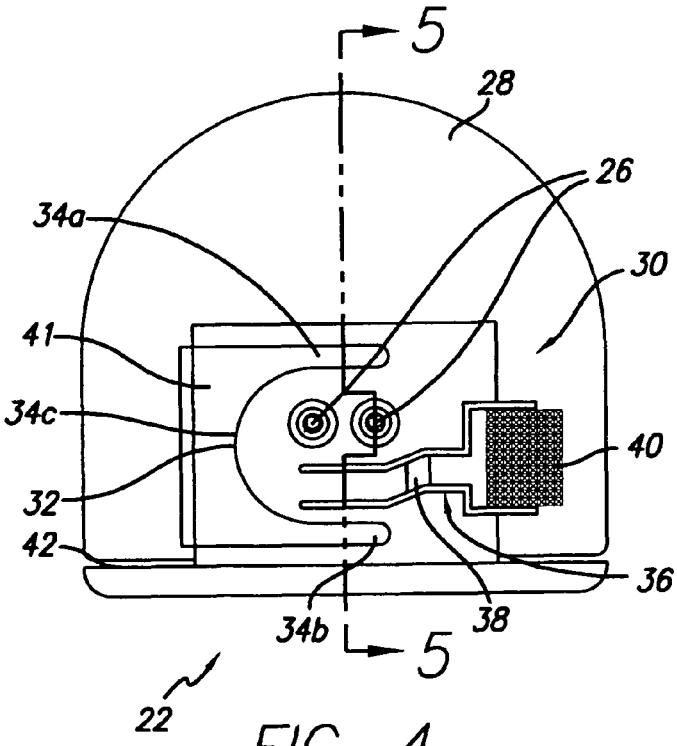
FIG. 4 is a side elevation view of a mount assembly included in the light of FIG. 2.
Figure 8:
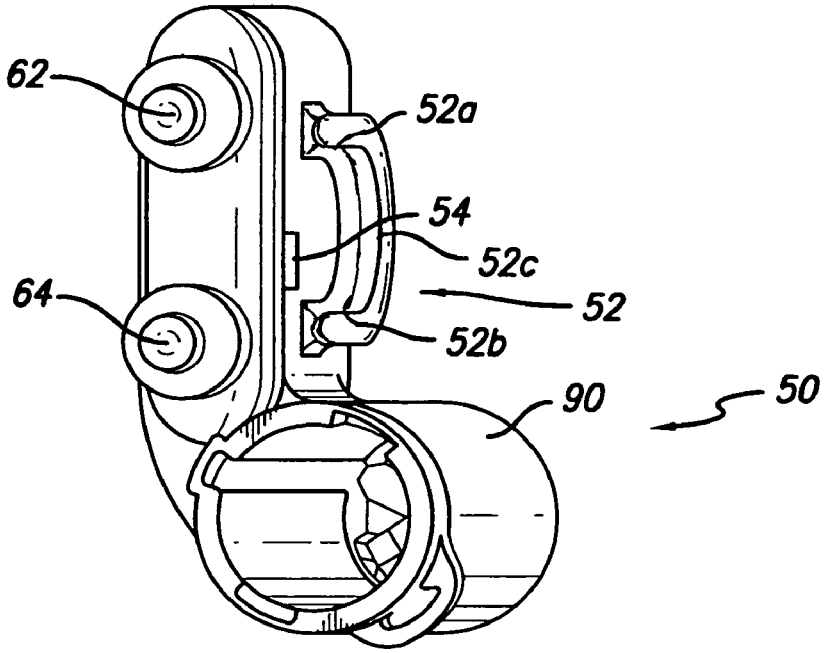
FIG. 8 is a rear perspective view of the light body of the light of FIG. 2.

The docking base 30, best seen in FIGS. 4, 5, and 6, includes a first attachment device on a side of the docking base 30, for cooperating with a second attachment device on the light body 50 as shown in FIG. 8, for quickly and rigidly installing the light body 50 on the docking base 30 and for quickly removing the light body 50 therefrom. In the preferred embodiment, the docking base attachment device includes an attachment guide 32, an attachment channel 34, and a quick-release latching lever 36 with latch 38 and quick-release button 40. A "vertical" landing area 41 and a "horizontal" landing area 42 may also be included in the docking base 30.

The preferred attachment device of the light body 50, for rigidly attaching the light body 50 to the docking base 30, includes an attachment rail 52 on the light body 50 that engages the attachment channel 34 in the docking base 30. The attachment rail 52 comprises two parallel spaced-apart attachment rails 52*a* and 52*b* that are joined together at one end with a continuous U-shaped rail 52*c* and that are open at their other end.

The attachment channel 34 comprises two parallel spaced-apart attachment channels 34*a* and 34*b* joined together at one end with a continuous U-shaped channel 34*c* and that are closed at their other end. Once the attachment rails 52 are fully engaged with the attachment channels 34, the light body 50 is held in full engagement by a locking device preferably comprising the latching lever 36 with the latch 38 that automatically engages a catch or slot 54 in the light body 50. Once the latch 38 has automatically engaged the slot 54, the light body 50 is in locked engagement with the docking base 30.

In the preferred embodiment, the light body 50 has a visible light source 56, e.g., a high luminous flux LED, a night vision light source 58, e.g., an invisible infrared LED or a visible red LED, and an IFF light source 60. A single three-position toggle switch 62 typically controls the visible light source 56 and the night vision light source 58. A separate switch 64 typically controls the IFF light source 60.

For security purposes, the IFF light source 60 is preferably invisible but may be of any color and may blink at any frequency or in any pattern. Such blinking constitutes an intermittent operation and the interval and duration of intermittence may be varied in any manner to achieve any desired blinking pattern.

In the preferred embodiment, a brightness control button 66 controls the brightness of the visible light source 56. Each instance of depressing the brightness button 66 activates, in fixed sequence, one of three levels in a brightness cycle, namely, low, medium, and high. The visible light source 56, night vision light source 58, and IFF light source 60 are all typically powered by a single battery, e.g., a 3 volt lithium battery, carried in the light body 50.

Once the mount assembly 22 is secured to the brim of the helmet 19, preferably along a side of the helmet 19, an individual wearing the helmet 19 can readily install the light body 50 on, or remove the light body 50 from, the mount assembly 22 in a substantially continuous one-handed motion, using the hand at the same side of the helmet on which the mount assembly 22 is mounted. An individual can complete such installation and removal of the light body 50 in total darkness without the need to make any visual contact with the light 20 or the helmet 19.

To install the light body 50 on the mount assembly 22, the light body 50 is held in one hand and the attachment rails 52 are aligned with the attachment channels 34. The battery housing 90 may assist the user in orienting the light body 50 so that the attachment rails 52 are roughly aligned with the attachment channels 34.

The U-shaped guide 32 of the attachment channels 34 acts as an automatic self-centering mechanism to ensure easy engagement of the attachment rails 52 with the attachment channels 34. This U-shaped guide 32 is large enough so that a user can locate it by feel with a single hand and without the need for visual reference or assistance. A "vertical" landing area 41 and a "horizontal" landing area 42 are both located near the U-shaped guide 32 and each such area provides a tactile reference point that can assist the user in properly aligning the attachment rails 52 with the attachment channels 34.

Once the user aligns the attachment rails 52*a*, 52*b* with the attachment channels 34*a*, 34*b*, the light body 50 can then be installed on the docking base 30 by simply pushing the light body 50 toward the quick-release button 40 (i.e., in a rearward direction) until the light body 50 can be pushed no further. The light body 50 is stopped from making contact with the quick-release button 40 because the attachment rails 52 are prevented from further movement by the presence of the U-shaped rail 52*c* coming into contact with the U-shaped channel 34. The light body 50 is further stopped from making contact with the quick-release button 40 because the attachment rails 52 are prevented from further movement by the presence of the closed end of the attachment channels 34*a* and 34*b*. As the light body 50 reaches this position, the light body 50 trips the latch 38 of the resilient latching lever 36 to engage the catch or slot 54, automatically and releasably locking the light body 50 to the docking base 30.

As previously noted, the latch 38 and quick-release button 40 are both located on the quick-release latching lever 36 that is part of the docking base 30. The quick-release lever 36 is resilient so that when the quick-release lever 36 is operated, the quick-release lever 36 automatically returns toward the position it was in prior to being actuated. The latch 38 is tapered so that as the light body 50 is pushed onto the docking base 30, the light body 50 moves across the taper of the latch 38 thereby displacing the latch 38.

When the light body 50 reaches the point where the attachment rails 52 fully engage the attachment channels 34, the catch or slot 54 on the light body 50 is then in a position such that the latch 38 automatically springs into engagement with the slot 54. This engagement keeps the light body 50 rigidly attached to the docking base 30 and, in turn, the mount assembly 22. The taper of the latch 38 and the raised position of the latch 38 in its normal state can be seen in FIGS. 4 and 6.

The latch 38 is disengaged from the slot 54 by depressing the quick-release button 40 and simultaneously sliding the light body 50 in a direction away from the quick-release button 40. Depressing the quick-release button 40 causes the latch 38 to move away from the slot 54 until the latch 38 is completely clear of the slot 54. At this point, the light body 50 can be pulled free and clear of the docking base 30.

Figure 9:
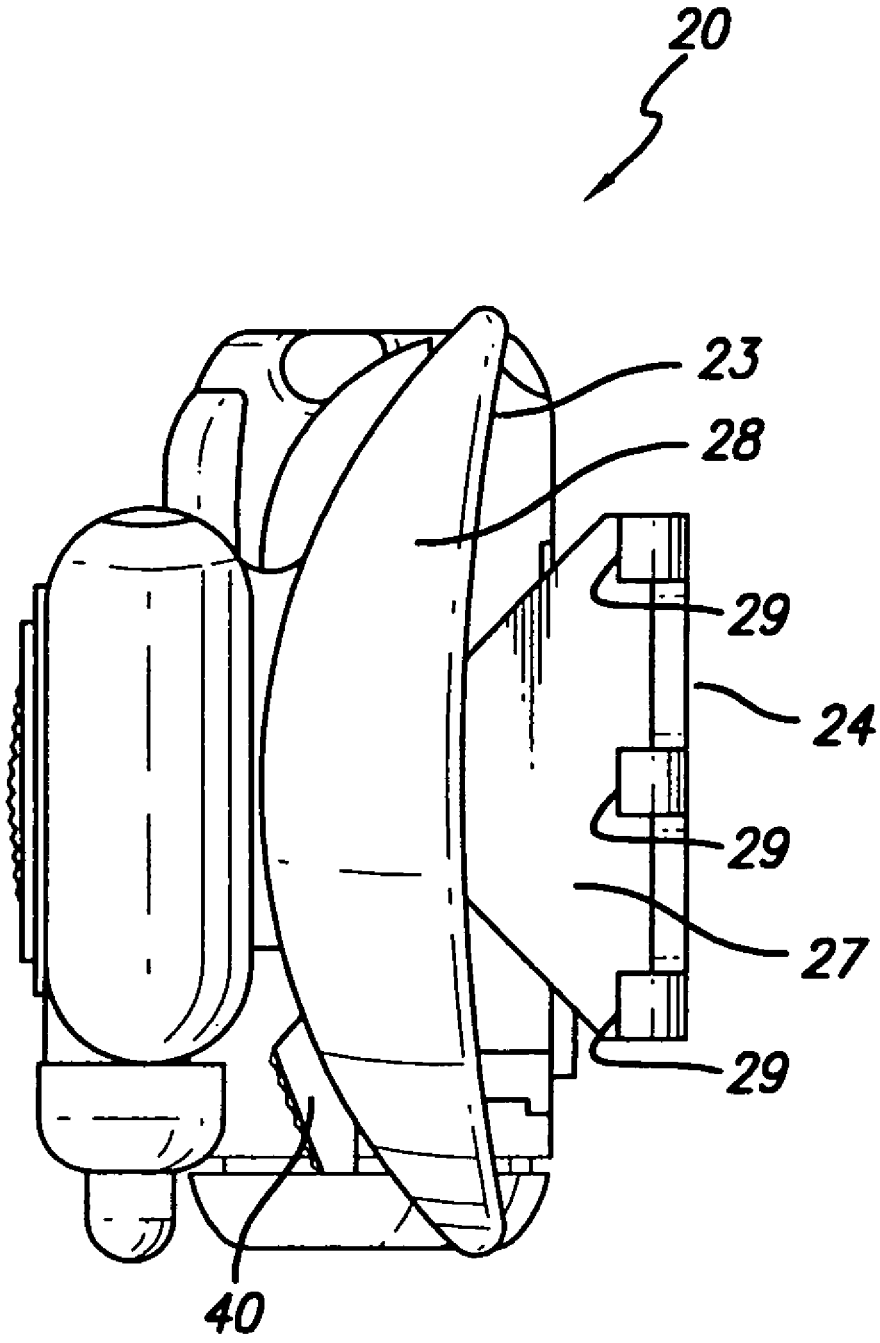
FIG. 9 is a top view of the light of FIG. 2.

The location of the quick-release button 40 with respect to the light body 50 and mount assembly 22 is best seen in FIG. 9. It may be appreciated that, to remove the light body 50 from the docking base 30, the user may grasp the light body with one hand while, with the thumb or a finger of the same hand, simultaneously depress the quick-release button 40 and slide the light body 50 forward along the channels 34*a*, 34*b* of docking base 30 until the light body 50 is removed from the docking base 30.

The foregoing description is for illustrative purposes only. It will be apparent to those skilled in the art that various changes and modifications can be made to the instant invention without departing from the overall spirit and scope of the instant invention. It is in that context that the following claims are made.

What I claim as my invention is:

1. Light apparatus comprising:
a helmet;
a docking base attached to said helmet;
a light body including at least one light source;
two spaced-apart parallel attachment channels on one of said docking base and said light body;
two spaced-apart parallel attachment rails on the other one of said docking base and said light body;
said parallel rails and said parallel channels slideably engageable for attaching said light body to said docking base;
a locking device automatically locking said light body to said docking base when said light body is displaced with respect to said docking base in a first direction along said parallel rails engaged with said parallel channels; and
an actuator for releasing said light body from said docking base when actuated and said light body is displaced with respect to said docking base in a second direction.

2. The light apparatus according to claim 1, wherein:
said actuator comprises a lever.

3. The light apparatus according to claim 1, including:
a mount assembly attached to said helmet and including said docking base.

4. The light apparatus according to claim 3, wherein:
said mount assembly is removably attached to said helmet.

5. The light apparatus according to claim 3, wherein:
said mount assembly includes a bracket secured to said docking base and removably attached to said helmet.

6. The light apparatus according to claim 5, wherein:
said mount assembly includes a resilient pad secured to said docking base and engaging said helmet when said bracket is attached to said helmet.

7. The light apparatus according to claim 1, wherein:
said first direction is a generally rearward direction when said helmet with said docking base attached thereto is worn by a user.

8. The light apparatus according to claim 1, wherein:
said two parallel channels are on said docking base; and
said two parallel rails are on said light body.

9. The light apparatus according to claim 8, including:
a U-shaped channel on said docking base and joining said two parallel channels at an end thereof; and
a U-shaped rail on said light body, and joining said two parallel rails at an end thereof.

10. The light apparatus according to claim 9, wherein:
said locking device includes a latching lever automatically locking said light body to said docking base when said rails are fully engaged with said channels.

11. The light apparatus according to claim 9, wherein:
contact of said U-shaped rail and said U-shaped channel when said parallel rails and said parallel channels are engaged prevents displacement of said light body with respect to said docking base in said first direction.

12. The light apparatus according to claim 1, including:
a U-shaped channel on said one of said docking base and said light body, said U-shaped channel joining said two parallel channels at an end thereof; and
a U-shaped rail on said other one of said docking base and said light body, said U-shaped rail joining said two parallel rails at an end thereof.

13. The light apparatus according to claim 7, wherein;
said locking device includes a latching lever automatically locking said light body to said docking base when said rails are fully engaged with said channels.

14. The light apparatus according to claim 12, wherein:
contact of said U-shaped rail and said U-shaped channel when said parallel rails and said parallel channels are engaged prevents displacement of said light body with respect to said docking base in said first direction.

15. The apparatus according to claim 1, wherein;
said second direction is generally opposite said first direction.

16. The apparatus according to claim 1, wherein;
said first direction is a generally rearward direction when said helmet is worn by a user.

17. A method of attaching a light apparatus, comprising:
providing a headgear including a docking base secured thereto;
providing a light body;
one of said docking base and said light body including two spaced-apart parallel attachment channels, and the other of said docking base and said light body including two spaced-apart parallel attachment rails;
placing said headgear on a user's head;
sliding said light body in a first direction onto said docking base with said parallel rails engaging said parallel channels; and locking said light body to said docking base with said parallel rails engaging said parallel channels.

18. The method according to claim 17, including:

unlocking said light body from said docking base; and sliding said light body off said docking base in a second direction opposite said first direction.

19. The method according to claim 18, wherein:

said first direction is a generally rearward direction and said second direction is a generally forward direction.

20. The method according to claim 18, wherein;

said headgear comprises a helmet.

21. The method according to claim 20, wherein;

said first direction is a generally rearward direction and said second direction is a generally forward direction.

22. The method according to claim 17, wherein:

said two parallel channels are on said docking base and said two parallel rails are on said light body.

23. The method according to claim 17, wherein the step of providing said headgear includes:

providing a mount assembly including said docking base; and securing said mount assembly to said headgear.

24. The method according to claim 17, wherein:

during the placing step, said headgear is placed on the user's head with said docking base positioned at a side of the user.

25. The method according to claim 17, wherein;

said first direction is a generally rearward direction.

26. The method according to claim 17, wherein;

said headgear comprises a helmet.

27. The method according to claim 26, wherein;

said two parallel channels are on said docking base; and said two parallel rails are on said light body.

28. The method according to claim 26, wherein;

said first direction is a generally rearward direction.

29. The method according to claim 26, wherein;

during the placing step, said helmet is placed on the user's head with said docking base positioned at a side of the user.

30. Light apparatus comprising:

a docking base;

a light body including at least one light source;

an attachment channel on one of said docking base and said light body, said attachment channel comprising two spaced-apart parallel channels and a U-shaped channel joining said parallel channels at an end thereof;

an attachment rail on the other one of said docking base and said light body, said attachment rail complementary to said attachment channel and comprising two spaced-apart parallel rails and a U-shaped rail joining said parallel rails at an end thereof;

said parallel rails and said parallel channels slideably engageable for attaching said light body to said docking base;

a locking device automatically locking said light body to said docking base when said light body is displaced with respect to said docking base in a first direction along said parallel rails engaged with said parallel channels and said U-shaped rail is engaged with said U-shaped channel; and an actuator for releasing said light body from said docking base when actuated and said light body is displaced with respect to said docking base in a second direction opposite said first direction.

31. The light apparatus according to claim 30, including:

a headgear having said docking base attached thereto.

32. The light apparatus according to claim 30, wherein;

said attachment channel is on said docking base; and said attachment rail is on said light body.

33. The light apparatus according to claim 32, including:

a headgear having said docking base attached thereto.

34. Light apparatus comprising:

a headgear;

a mount assembly attached to said headgear and including a docking base;

a light body including at least one light source;

two spaced-apart parallel attachment channels on one of said docking base and said light body;

two spaced-apart parallel attachment rails on the other one of said docking base and said light body;

said parallel rails and said parallel channels slideably engageable for attaching said light body to said docking base;

a locking device automatically locking said light body to said docking base when said light body is displaced with respect to said docking base in a generally rearward first direction along said parallel rails engaged with said parallel channels when said headgear with said mount assembly attached thereto is worn by a user; and an actuator for releasing said light body from said docking base when actuated and said light body is displaced with respect to said docking base in a second direction generally opposite said first direction.

35. Light apparatus comprising:

a headgear;

a docking base attached to said headgear;

a light body including at least one light source;

two spaced-apart parallel attachment channels on one of said docking base and said light body;

two spaced-apart parallel attachment rails on the other one of said docking base and said light body;

said parallel rails and said parallel channels slideably engageable for attaching said light body to said docking base;

a U-shaped channel on said one of said docking base and said light body, said U-shaped channel joining said two parallel channels at an end thereof: and a U-shaped rail on said other one of said docking base and said light body, said U-shaped rail joining said two parallel rails at an end thereof;

a locking device automatically locking said light body to said docking base when said light body is displaced with respect to said docking base in a first direction along said parallel rails engaged with said parallel channels; and an actuator for releasing said light body from said docking base when actuated and said light body is displaced with respect to said docking base in a second direction opposite said first direction.

36. The light apparatus according to claim 35, wherein:

said locking device includes a latching lever automatically locking said light body to said docking base when said rails are fully engaged with said channels.

37. The light apparatus according to claim 35, including:

said parallel channels and said U-shaped channel are on said docking base; and said parallel rails and said U-shaped rail are on said light body.

38. The light apparatus according to claim 37, wherein:

said locking device includes a latching lever automatically locking said light body to said docking base when said rails are fully engaged with said channels.

39. The light apparatus according to claim 37, wherein:

contact of said U-shaped rail and said U-shaped channel when said parallel rails and said parallel channels are engaged prevents displacement of said light body with respect to said docking base in said first direction.

40. The light apparatus according to claim 35, wherein:

contact of said U-shaped rail and said U-shaped channel when said parallel rails and said parallel channels are engaged prevents displacement of said light body with respect to said docking base in said first direction.

41. Light apparatus comprising:

a headgear;

a mount assembly including a docking base, a bracket secured to said docking base and removably attached to said headgear, and a resilient pad secured to said docking base and engaging said headgear when said bracket is attached to said headgear;

a light body including at least one light source;

two spaced-apart parallel attachment channels on one of said docking base and said light body;

two spaced-apart parallel attachment rails on the other one of said docking base and said light body;

said parallel rails and said parallel channels slideably engageable for attaching said light body to said docking base;

a locking device automatically locking said light body to said docking base when said light body is displaced with respect to said docking base in a first direction along said parallel rails engaged with said parallel channels; and an actuator for releasing said light body from said docking base when actuated and said light body is displaced with respect to said docking base in a second direction.

42. The light apparatus according to claim 41, wherein:

said second direction is opposite said first direction.

43. The light apparatus according to claim 41, wherein:

said two parallel channels are on said docking base; and said two parallel rails are on said light body.

* * * * *

UNITED STATES PATENT AND TRADEMARK OFFICE

CERTIFICATE OF CORRECTION

PATENT NO. : 8,292,450 B2
APPLICATION NO. : 12/798818
DATED : October 23, 2012
INVENTOR(S) : Paul Y. Kim It is certified that error appears in the above-identified patent and that said Letters Patent is hereby corrected as shown below:

Column 8, line 41, "claim 7" should be --claim 12--.

Signed and Sealed this
Twenty-ninth Day of January, 2013

David J. Kappos

David J. Kappos
*Director of the United States Patent and Trademark Office*